United States Patent [19]

Shore

[11] Patent Number: 5,067,301

[45] Date of Patent: Nov. 26, 1991

[54] BALLOON INFLATING MACHINE

[75] Inventor: William P. Shore, Ashfield, Australia

[73] Assignee: The Commonwealth Industrial Gases Ltd., St. Leonards, Australia

[21] Appl. No.: 566,598

[22] Filed: Aug. 13, 1990

[30] Foreign Application Priority Data

Aug. 15, 1989 [AU] Australia ..... PJ5785

[51] Int. Cl.[5] ..... B65B 31/06; B65B 67/12; B65B 43/36

[52] U.S. Cl. ..... 53/79; 53/88; 53/503; 53/504; 53/138.8

[58] Field of Search ..... 53/403, 483, 441, 84, 53/88, 79, 385, 503, 504, 52, 138.8; 141/4, 10, 65, 114, 173

[56] References Cited

U.S. PATENT DOCUMENTS

| | | | |
|---|---|---|---|
| 2,197,527 | 4/1940 | Madden | 53/79 X |
| 3,111,796 | 11/1963 | Meissner | 53/483 |
| 3,380,490 | 4/1968 | Ellenberg et al. | 141/173 X |
| 3,401,499 | 9/1968 | Jahnke | 53/138 A X |
| 3,536,110 | 10/1970 | West | 141/173 X |
| 3,580,303 | 5/1971 | Roberge | 141/173 |
| 3,616,823 | 11/1971 | Dello Iacono | 141/173 X |
| 3,629,992 | 12/1971 | Price et al. | 53/370 |
| 4,088,161 | 5/1978 | Ikemoto | 141/173 X |
| 5,016,428 | 5/1991 | Helling et al. | 53/88 X |

FOREIGN PATENT DOCUMENTS

| | | | |
|---|---|---|---|
| 274000 | 7/1927 | United Kingdom | 53/403 |

*Primary Examiner*—Horace M. Culver

*Attorney, Agent, or Firm*—David A. Draegert; Robert I. Pearlman

[57] ABSTRACT

An apparatus for inflating balloons of the kind having a body and a filling neck terminating in a beaded edge, said apparatus comprising a balloon support plate having a sealing surface and an open ended slot extending from one edge thereof to receive the filling neck of a balloon such that the beaded edge is adjacent said sealing surface and the body of the balloon is disposed on the remote side of the plate; a filling head selectively moveable toward said sealing surface to clamp said beaded edge between the filling head and sealing surface and establish a substantially gas tight seal between the filling head and beaded edge; and a pressurized gas flow passage through said filling head to the neck of a clamped balloon for inflation of the balloon. The apparatus further includes means for stretching, twisting and sealing the neck of the inflated balloons. In a preferred embodiment has the apparatus has a plurality of support plates mounted on a conveyor in the form of an endless loop. A plurality of filling heads are provided around the loop which includes suitable indexing means to respectfully align each slot with one of the filling heads.

18 Claims, 11 Drawing Sheets

BALLOON INFLATING MACHINE

TECHNICAL FIELD

This invention relates to the inflation of balloons of the kind having a body and a filling neck terminating in a beaded edge.

BACKGROUND ART

Mass releases of balloons filled with a lighter than air gas mixture are commonly used to promote major public events. These releases require the filling of many thousands of balloons over a relatively short period of time because the balloons remain properly inflated for only a limited time usually several hours. Hitherto the balloons have been filled manually by teams of people each using a manually operated filling device. Typically the manual filling devices include a nozzle over which the neck of the balloon is stretched before being inflated with gas from a pressurized source. The gas flow is controlled by a manually operated valve and the degree of inflation is determined visually by the operator. After inflation the balloon is removed from the nozzle and the neck of the balloon is sealed with a tying device applied by the operator. This method of inflating balloons suffers from several inherent disadvantages including:

(a) It is labour intensive and time consuming. A skilled operator has difficulty filling more than about 175 balloons per hour. Consequently many operators are required to inflate the thousands of balloons required for mass releases within the relatively short inflated balloon lifetime.

(b) The manual stretching of the balloons over the prior art filling nozzle can lead to damage of the filling neck and failure of the balloon.

(c) The visual determination of degree of inflation results in non uniformity of balloon size and, in cases of over inflation, failure of the balloon.

(d) Removal of the balloons from the prior art filling nozzle and manual tying can also result in gas loss and/or damage to the balloon.

It is an object of this invention to provide an apparatus for filling balloons which will overcome, or at least ameliorate, one or more of the above disadvantages.

DISCLOSURE OF INVENTION

Accordingly, this invention consists in an apparatus for inflating balloons of the kind having a body and a filling neck terminating in a beaded edge, said apparatus comprising a balloon support plate having a sealing surface and an open ended slot extending from one edge thereof to receive the filling neck of a balloon such that the beaded edge is adjacent said sealing surface and the body of the balloon is disposed on the remote side of the plate; a filling head selectively moveable toward said sealing surface to clamp said beaded edge between the filling head and sealing surface and establish a substantially gas tight seal between the filling head and beaded edge; and a pressurised gas flow passage through said filling head to the neck of a clamped balloon for inflation of the balloon.

Preferably, the slot width is about two times the bead thickness. More preferably the slot width is between two times the bead thickness to two times the bead thickness plus 1 mm for easy insertion of the balloon and effective sealing during inflation. In this regard it has been found that the balloon will only pull through a narrower slot with difficulty and with a width in excess of two times the slot width plus 1 mm it may be difficult to achieve and maintain an effective seal.

Preferably, the support plate has a plurality of the open ended slots extending from one edge thereof and is mounted with conveyor means to sequentially align each slot with a filling head. In a preferred form the conveyor means are in the form of an endless loop with a plurality of the support plates mounted thereon. A plurality of filling heads can be provided around the closed loop and suitable indexing used to respectively align each slot with one of the filling heads.

Sensor means are preferably provided to detect the degree of inflation of each balloon and terminate filling uniformly. This can be achieved for example by means of a suitably positioned limit switch or optical detector providing a control signal used to switch an electrically controlled gas supply valve.

Preferably, attachment means are provided to grip the body of an inflated balloon to pull the body away from the support plate whilst the beaded edge is clamped thereby stretching the balloon neck to allow application of a suitable neck sealing device. Preferably the extension ratio of stretched rubber to unstretched rubber should be between three and six inclusive. In the preferred embodiment the attachment means rotates the body of the balloon with respect to the clamped beaded edge after stretching to result in tight twisting of the neck. A sealing element is applied to the twisted neck to seal the balloon. This is preferably done by a conventional bag sealing device which applies a piece of adhesive tape to the twisted neck. Preferably for a 12 mm sealing strip, the number of twists within the 12 mm length required to minimize the risk of leakage is at least one and no more than three. The tape ensures that a portion of the neck remains tightly twisted after release by the attachment means to provide sealing of the neck of the balloon.

In use balloons are manually positioned in the open ended slots of the support plates and thereafter the filling process is fully automated. In this way many balloons can be filled rapidly to uniform size without the risk of damage by manual stretching over a nozzle or the like.

One embodiment of this invention will now be described, by way of example only, with reference to the accompanying drawings in which:

BEST MODE FOR CARRYING OUT THE INVENTION

Figure 1:
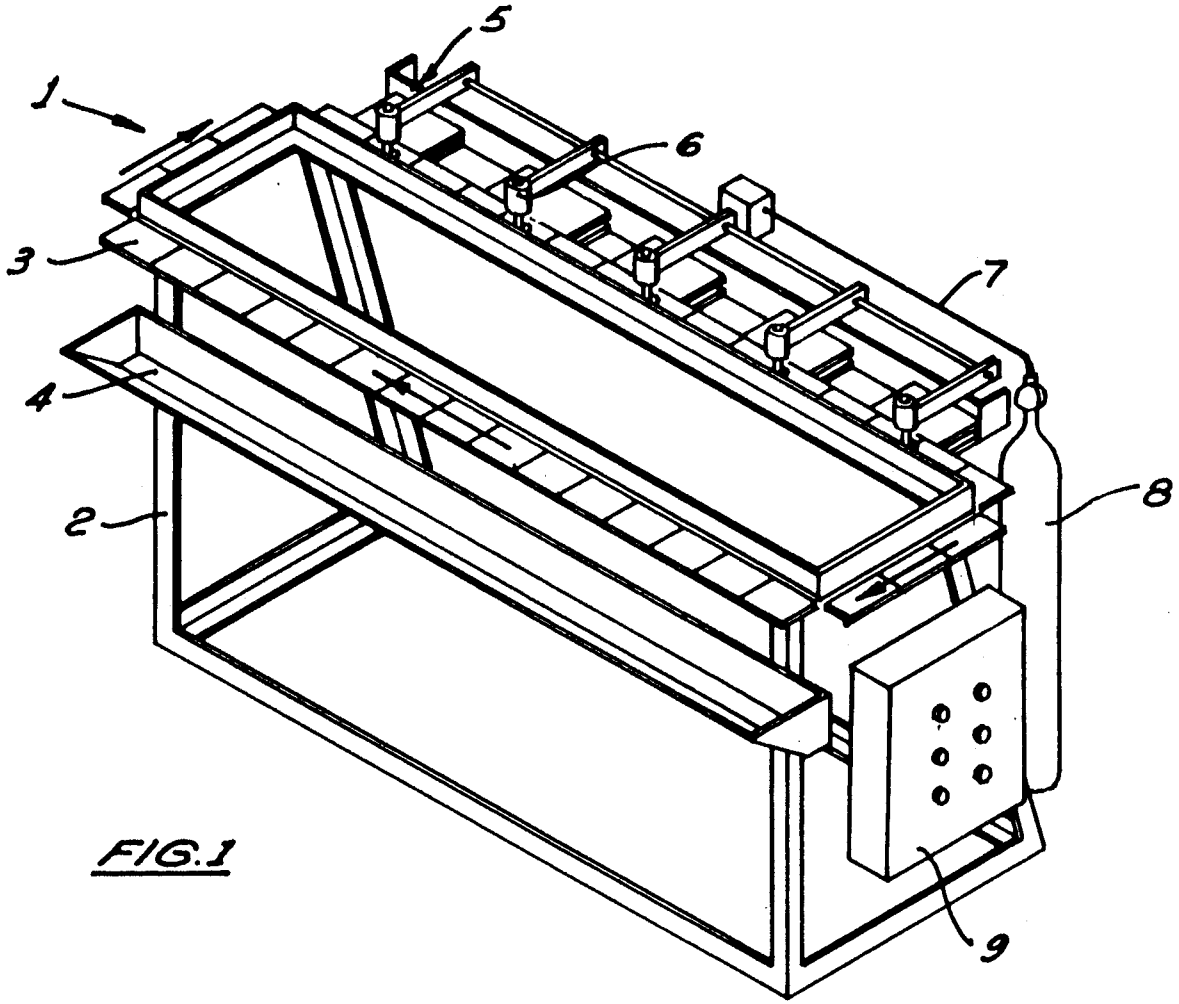
FIG. 1 is a schematic perspective view of an apparatus for inflating balloons according to this invention.

Referring to FIG. 1 there is shown a schematic perspective view of a semi-automatic balloon inflating apparatus, comprising a rectangularly configured chain driven conveyor loop indicated generally at 1, supported at a fixed height from the floor by a steel framework 2. The conveyor loop 1 comprises a plurality of balloon support or hanger plates 3. One length of the conveyor loop 1 has a balloon trough 4 provided below the conveyor path and mounted to framework 2. Five balloon filling stations shown generally at 5 are positioned along the opposing side of conveyor loop 1. Each filling station comprises a filling head 6 and neck sealing device (not shown) located below the hanger plates 3. Helium supply lines shown generally at 7 are connected by the usual coupling means to filling heads 6. A cylinder of compressed helium 8 is connected with the other end of supply line 7. A control panel 9 is also mounted with framework 2.

Figure 2:
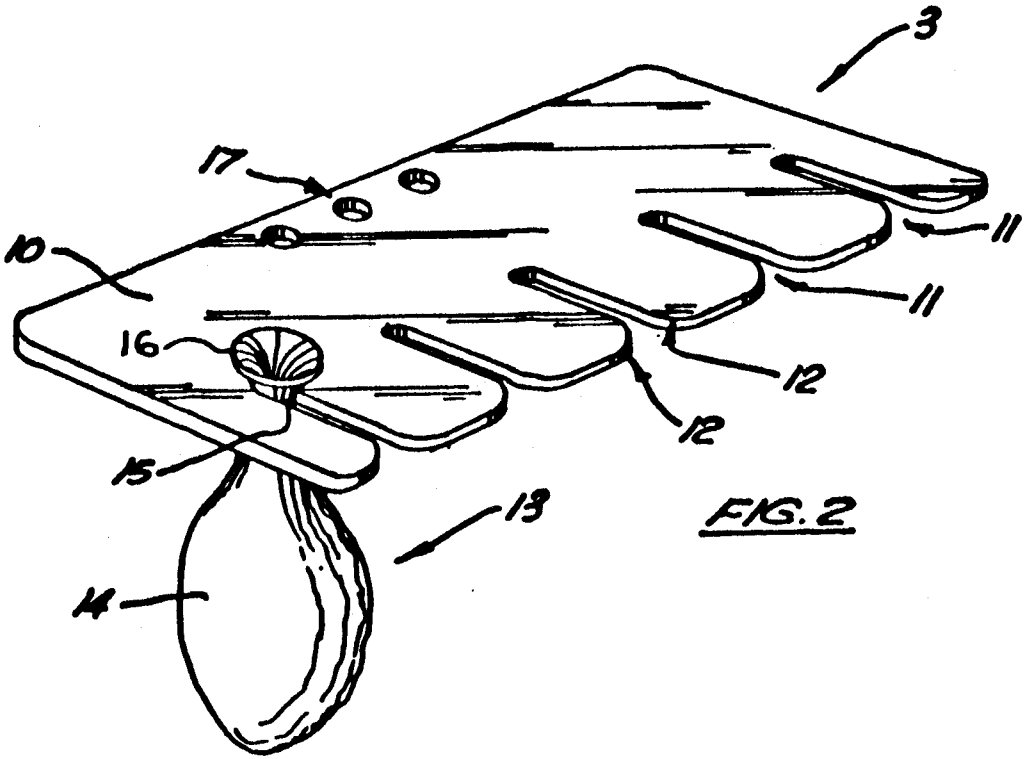
FIG. 2 is a perspective view of a balloon support plate forming part of the apparatus of FIG. 1.

Referring to FIG. 2 the balloon hanger or support plate 3 is shown in greater detail. The support plate is generally rectangular and has a substantially flat upper sealing surface 10. Five equispaced slots 11 extend inwardly from one longitudinal edge of the plate 3. The two end slots 11 are positioned at one half spacings from the edge of the plate 3 so that respective end slots of adjacent and abutting like plates 3 are spaced by approximately the same amount as any other adjacent pair of slots. The mouth of each slot 11 is rounded at 12 to prevent damage to balloons 13 inserted into the slot. Balloon 13 is of the kind having a body 14 and a filling neck 15 terminating in a beaded edge 16. Slots 11 receive the balloon 13 such that the neck 15 is disposed within the slot and the beaded edge 16 is adjacent sealing surface 10. The body 14 of the balloon is disposed on the remote side of the plate 3 to the sealing surface 10. Three holes 17 are provided in plate 3 for attachment to the conveyor loop as shown in more detail in FIGS. 3 to 5.

Figure 3:
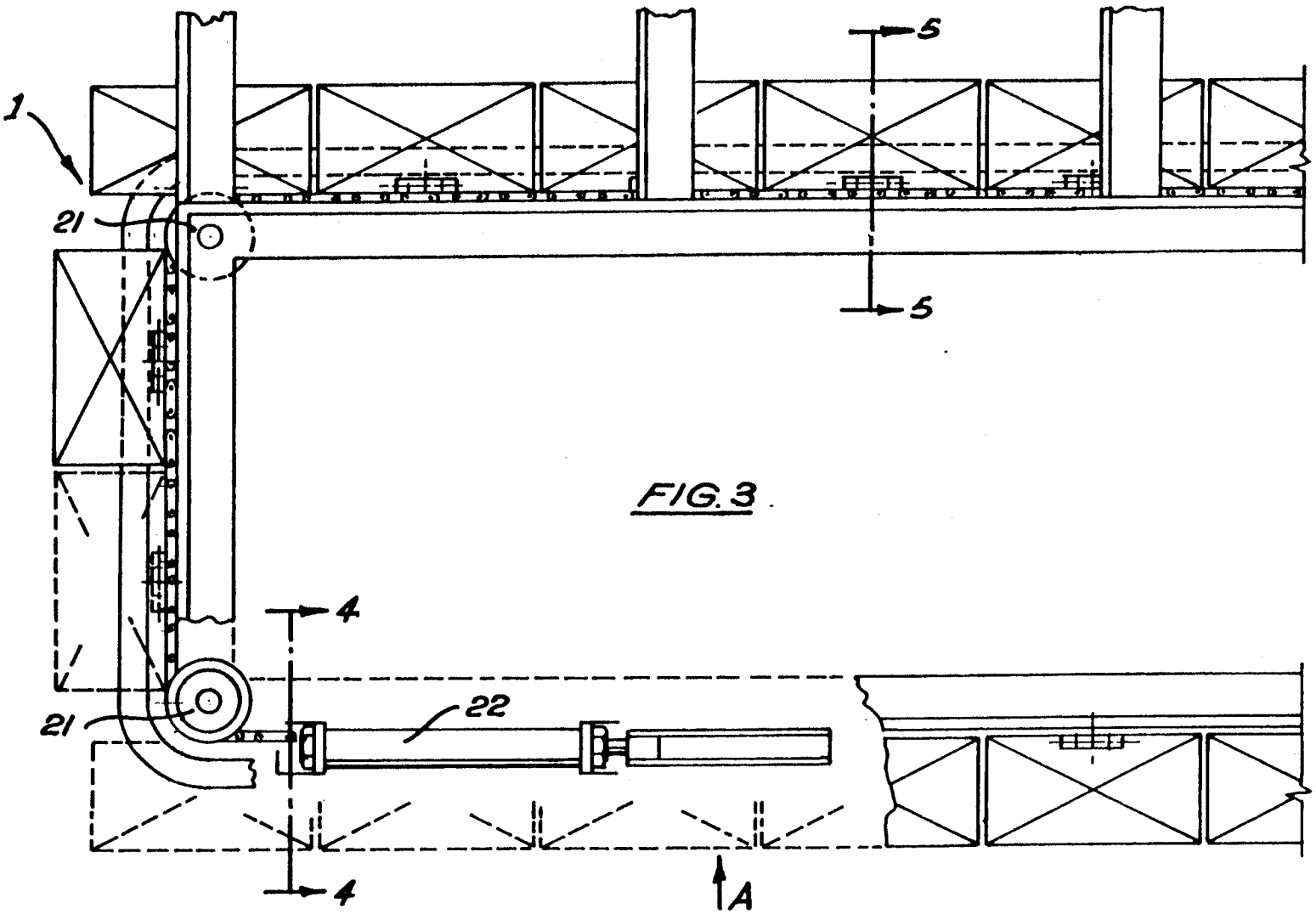
FIG. 3 is a more detailed plan view of part of the apparatus shown in FIG. 1.
Figure 4:
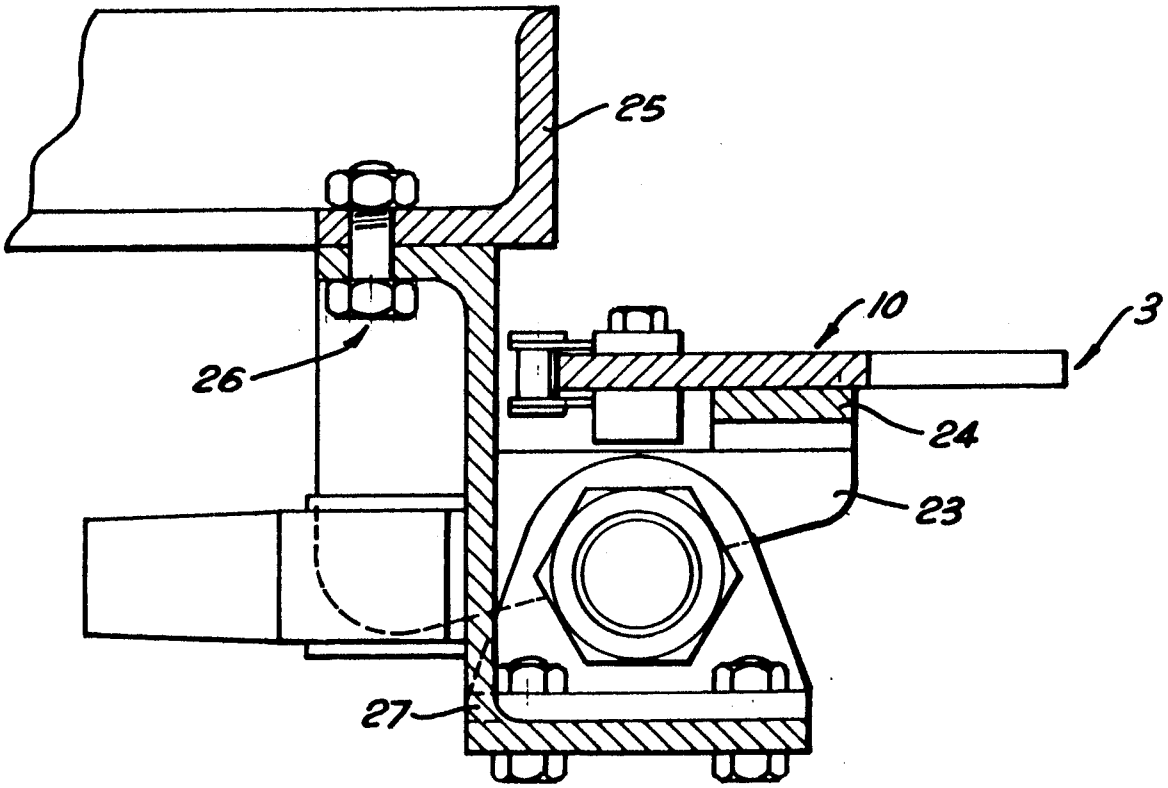
FIG. 4 is a sectional view along the line 4—4 of FIG. 3.
Figure 5:
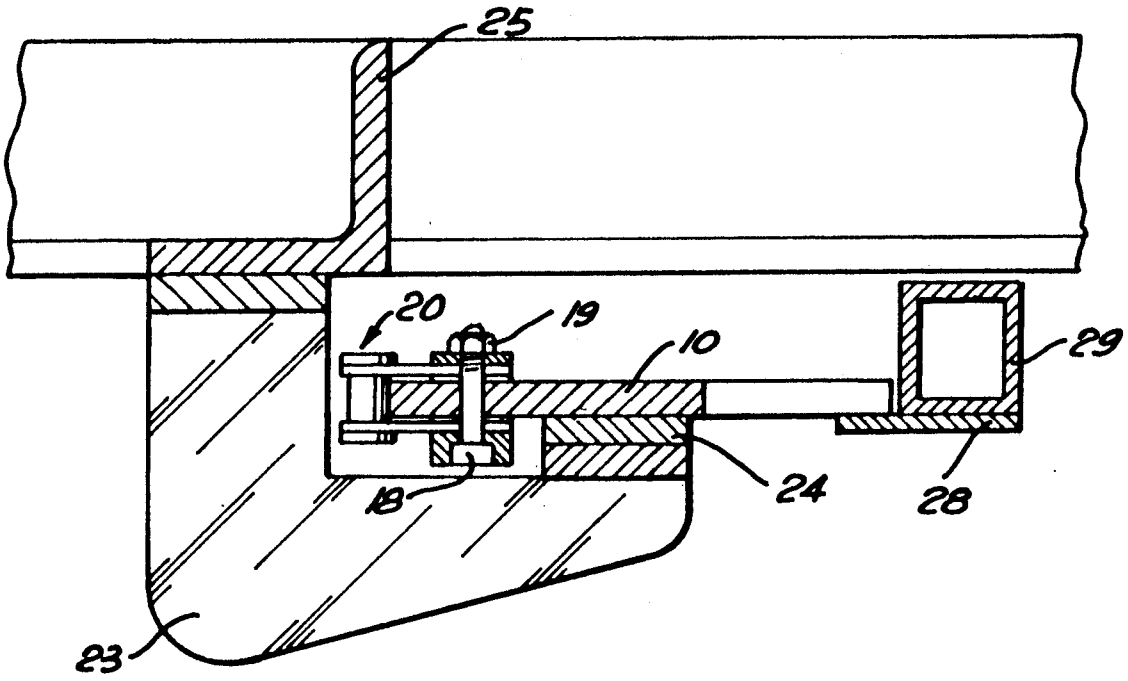
FIG. 5 is a sectional view along the line 5—5 of FIG. 3.

Referring to FIGS. 3 to 5 bolts 18 pass through holes 17 and receive nuts 19 to fasten the plate to an endless chain 20. The plates 3 secured to chain 20 in this manner are thus able to be moved around a rectangular endless loop as described above. The conveyor loop 1 has a roller 21 disposed at each corner to guide the chain 20. As shown in FIG. 3 a pneumatic cylinder 22 is provided to drive the conveyor in a step like manner as will be described below.

FIG. 4 shows a sectional view of the near side of conveyor loop 1. One of a number of rail support brackets 23 to which an inner rail 24 is mounted as shown. The bracket 23 is secured to the underside of a top frame member 25 forming part of framework 2 by fastening means (not shown). Inner rail 24 extends around the full perimeter of conveyor loop 1 and plates 3 rest upon the rail so that they are maintained in a horizontal orientation. A further support bracket 27 is also secured to frame member 25 by a bolt and nut 26 to support pneumatic cylinder 22.

FIG. 5 shows a sectional view of the far side of conveyor loop 1. In addition to inner rail 24 a further outer support rail 28 is provided along the region of the conveyor loop in which the filling heads 6 are positioned. Outer rail 28 is supported by a further frame member 29 appropriately secured by means not shown to framework 2. The inner rail 24 and outer rail 28 provide support on each longitudinal side of plates in region in which the filling head 6 bears tightly against sealing surface 10. This prevents deflection of hanger plate 3 during the filling operation.

Figure 6:
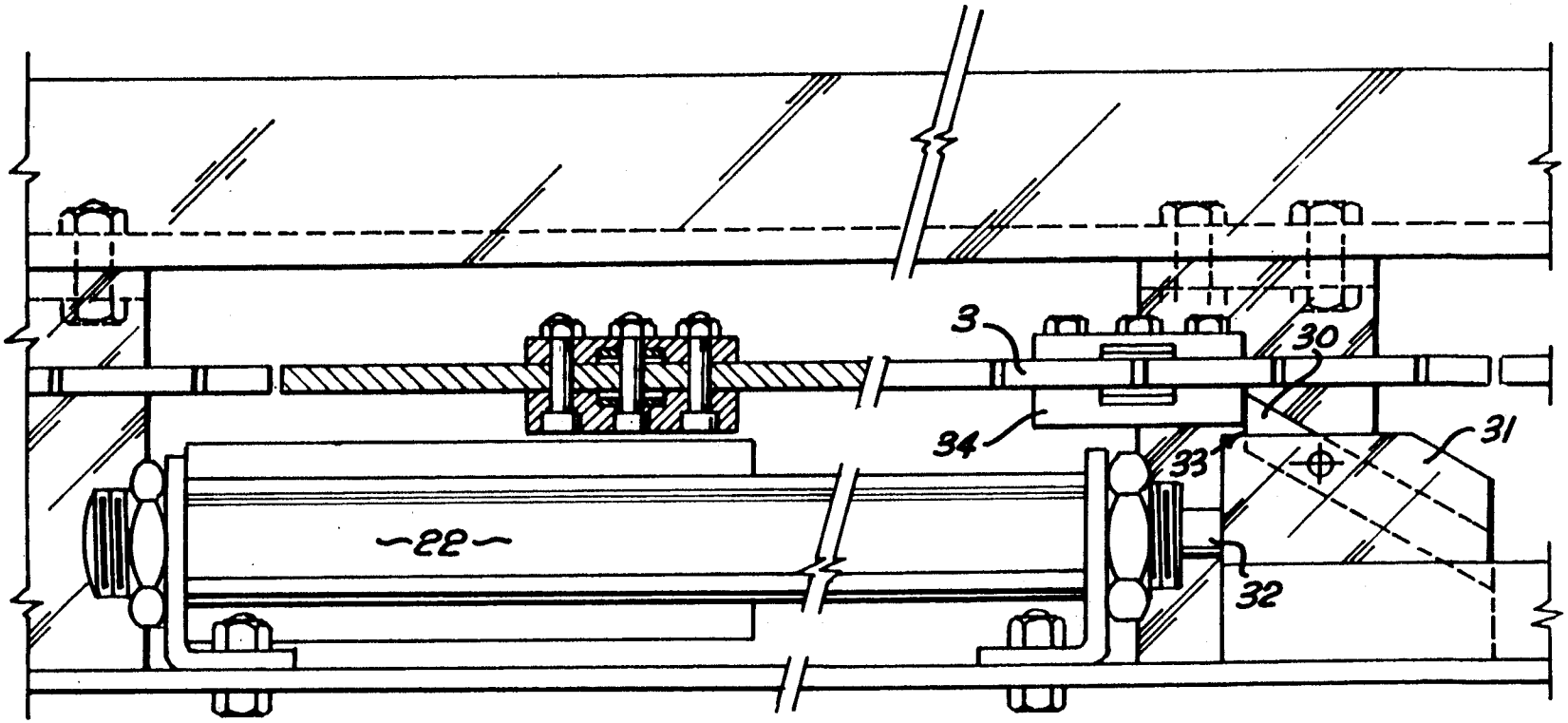
FIG. 6 is a view in the direction of arrow A in FIG. 3.
Figure 7:
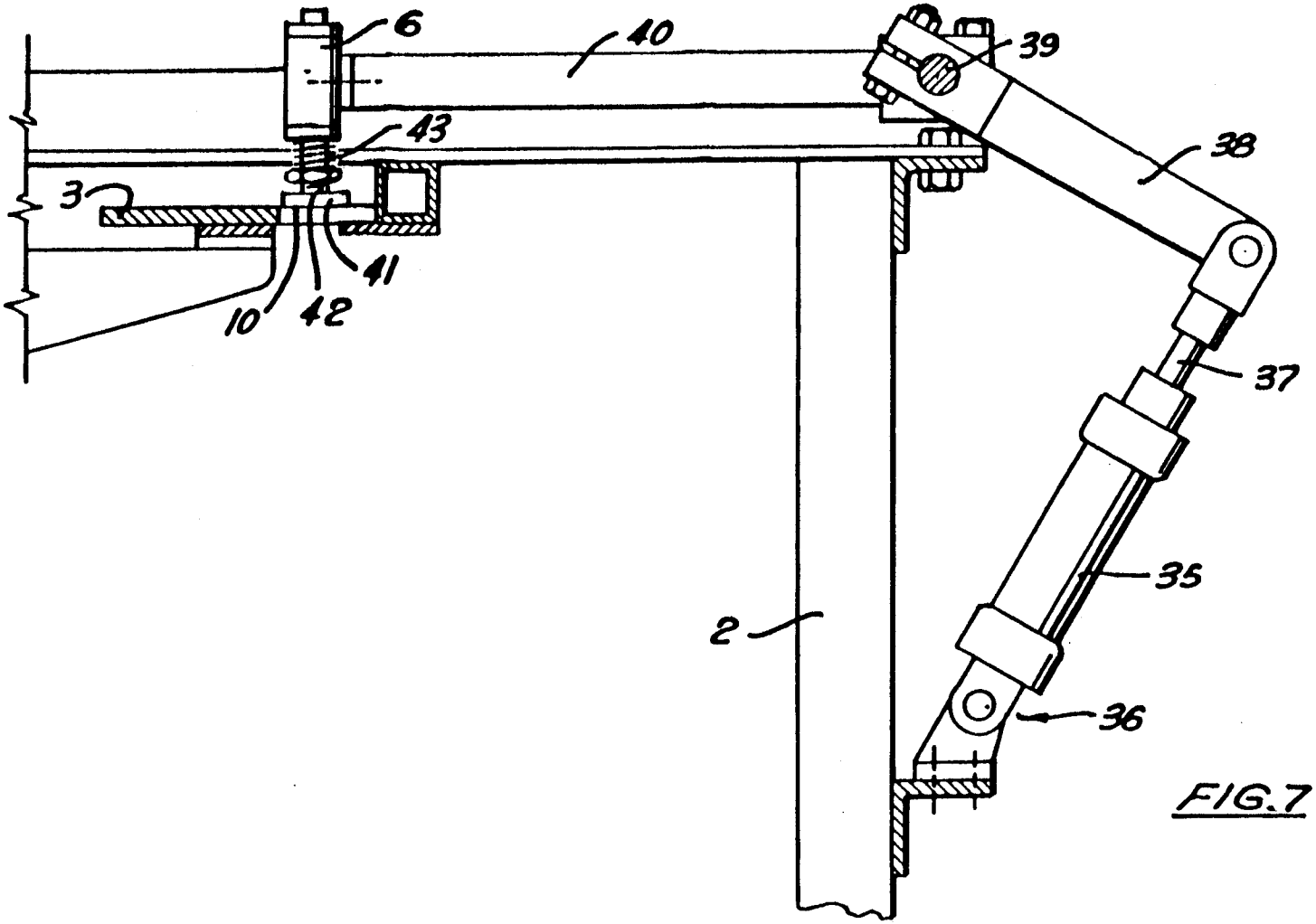
FIG. 7 is a more detailed end elevation of a further part of the apparatus shown in FIG. 1.

FIG. 6 shows the pneumatic cylinder 22 which provides step like movement of the conveyor loop so as to sequentially align each slot 11 with one of filling heads 6. This is achieved by means of a pawl 30 pivotally mounted with a pawl block 31 which is attached to the piston rod 32 of pneumatic cylinder 22. Pawl 30 has a bearing face 33 which, in use, bears against a block 34 secured to the underside of plate 3. The pneumatic cylinder 22 is shown in the fully retracted position. As the piston rod 32 is extended, to the right in FIG. 6, pawl 30 is biased upwardly by the action of gravity but is deflected by the next block 34 encountered in its stroke. Once past the next block 34 the action of pneumatic cylinder 22 is reversed and the bearing face 33 of the pawl engages the next block 34 to draw the conveyor loop past the pneumatic cylinder. In this way an indexed movement of conveyor loop 1 is achieved. FIG. 7 shows the clamping mechanism used to clamp filling head 6 against sealing surface 10 of plate 3. This mechanism comprises a pneumatic cylinder 35 hingedly mounted to frame 2 at 36. The piston rod 37 of cylinder 35 is pivotally connected to an actuating arm 38 in turn clamped to an axle 39. Axle 39 is mounted by means of suitable bearings (not shown) with framework 2 and it will be apparent that extension and retraction of piston rod 37 causes a limited rotation of axle 39. A mounting arm 40 is similarly clamped to axle 39 and filling head 6 is mounted with the remote end of arm 40. It will thus be apparent that the pneumatic cylinder 35 provides a means of raising and lowering sealing head 6 so that it can be brought to bear against sealing surface 10. The path length is adjusted by the lengths of the respective arms and the arrangement is oriented such that arm 40 is substantially horizontal when filling head 6 makes contact with sealing surface 10. This ensures that the annular clamping flange 41 forming part of filling head 6 is parallel to sealing surface 10. The filling head 6 is connected with a helium line 7 shown in FIG. 1 and includes an electrically actuated solenoid valve (not shown). The annular clamping flange 41 is reciprocally mounted by means of a stem 42 which extends into the body of filling head 6. The annular flange 41 is biased toward an extended position by means of a spring 43. The annular clamping flange 41 is substantially a flat disc of metal of approximately 35 mm diameter perforated by a 3 mm hole. The 3 mm hole (not shown) is in fluid flow communication via a solenoid actuated valve to the helium supply line 7. It has been found that when a balloon 13 is positioned in slot 11 in the manner shown in FIG. 2 and the beaded edge 16 of the balloon clamped between the sealing surface 10 and annular clamping flange 41 a substantially gas tight seal is provided between the beaded edge and the clamping flange 41. Thus gas expelled from the centrally located aperture in the clamping flange is directed into balloon 13 to inflate the balloon. Axle 39 extends lengthwise along one side of the conveyor loop 1 and each of the filling heads 6 is mounted by means of a separate arm 40. In this way the one pneumatic cylinder 35 can be used to simultaneously effect movement of each filling head 6.

Figure 8:
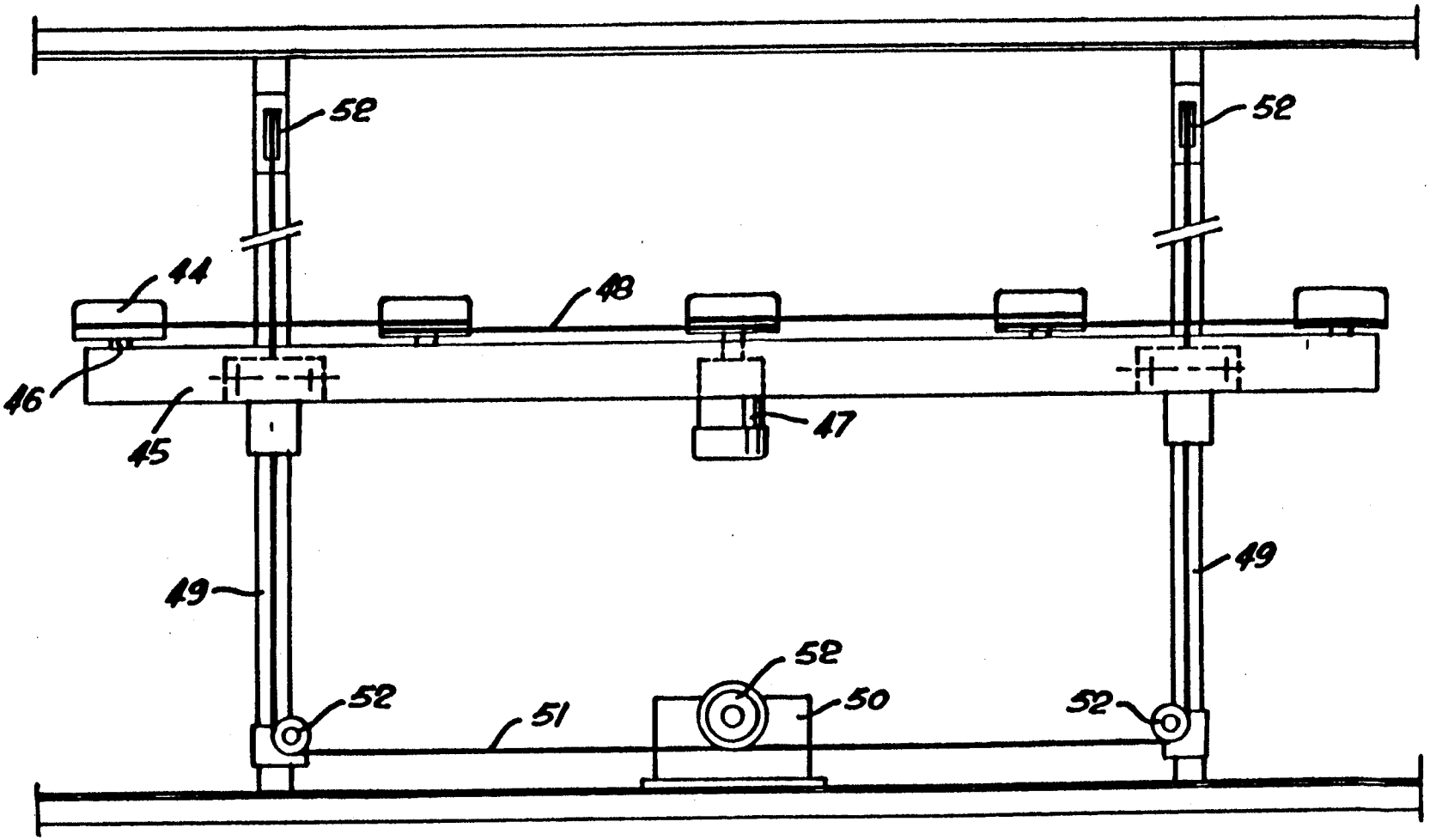
FIG. 8 is a detailed elevation of a further part of the apparatus shown in FIG. 1.
Figure 9:
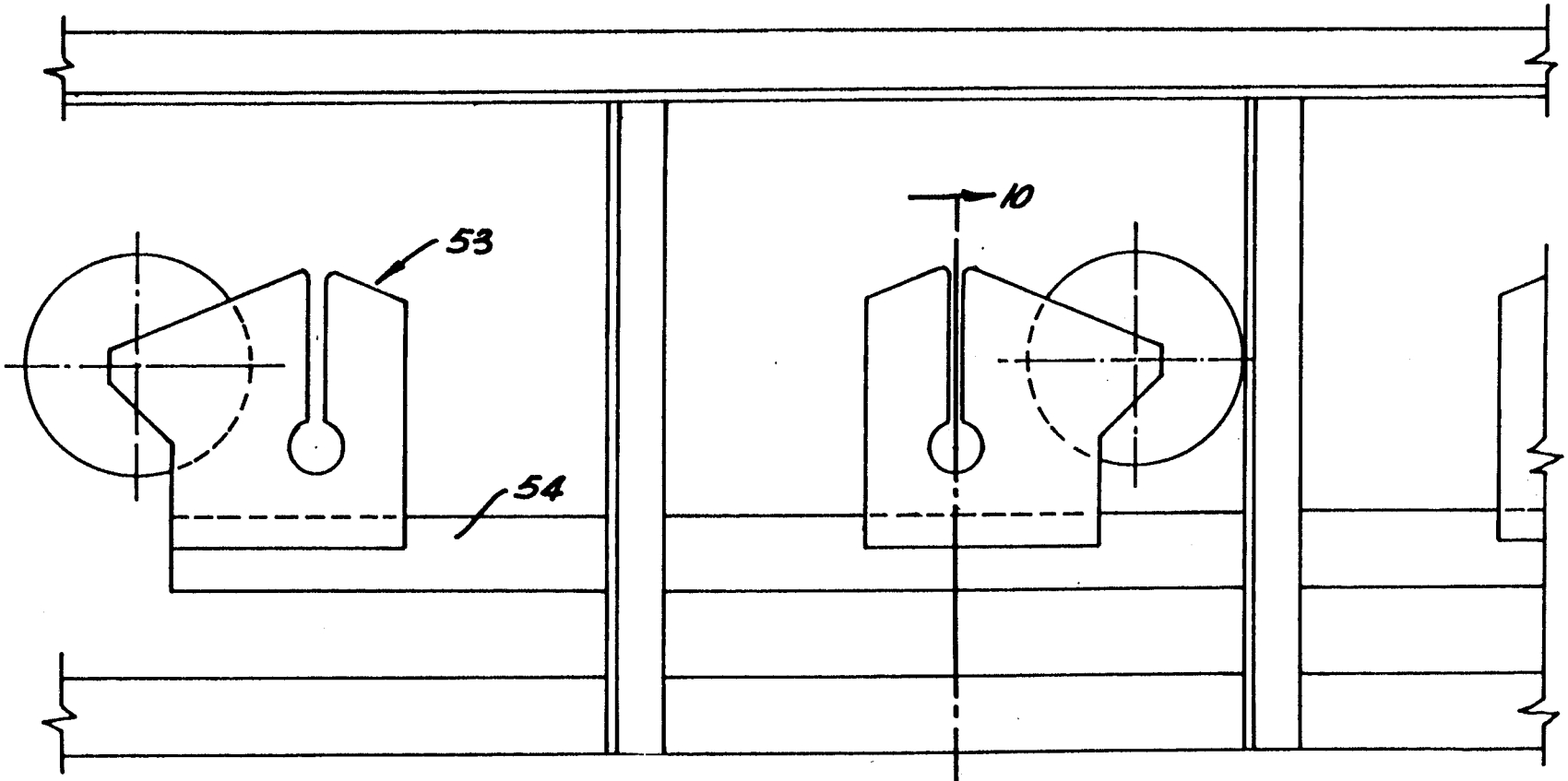
FIG. 9 is a detailed plan view of a further part of the apparatus shown in FIG. 1.

FIGS. 8 and 9 show the means by which the balloons are sealed. Five suction caps 44 are each rotatably mounted with a horizontal beam 45. Four of the suction caps 44 are provided with shafts 46 which are suitably bearinged in horizontal member 45. One of the suction caps 45 is driven from the shaft of an electric motor 47. A cylindrical portion of each of the suction caps is interconnected by means of belts 48 so that rotation of one of the caps by means of motor 47 effects the rotation of all. Beam 45 is slideably mounted with two uprights 49 forming part of frame 2 for upward and downward movement. The upward and downward movement of beam 45 is effected by means of an electric motor 50, cable 51 and pulleys 52. Each of suction caps 44 is located directly below a corresponding filling head 6. Horizontal beam 45 is moved upwardly to a raised position so that when a balloon 13 positioned in slot 11 as shown in FIG. 2 and inflated in the manner described above, the balloons expand into suction cap 44. A vacuum is subsequently supplied to suction caps 44 to grasp the inflated balloon. The balloon 13 is then drawn downwardly whilst still being clamped at its upper end so that the neck 15 is substantially stretched. During stretching the suction caps 44 are rotated to result in a tight twisting of the neck portion of the balloon.

Figure 10:
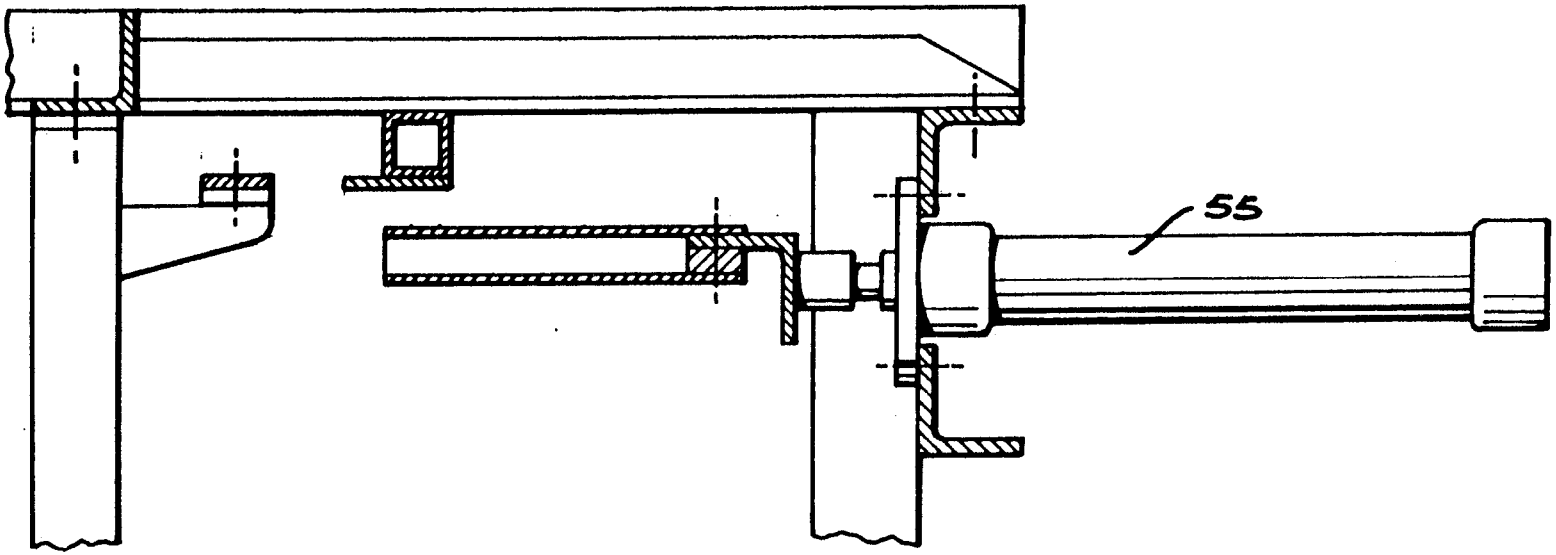
FIG. 10 is a sectional view along the line 10—10 of FIG. 9.

Substantially conventional bag sealers 53 shown in FIGS. 9 and 10 are mounted for reciprocating horizontal movement and are spaced apart to coincide with the position of the twisted necks 15 of the balloons. This is achieved by mounting the bag sealers 53 on a frame 54 which is reciprocally moveable in a horizontal direction by means of a pneumatic cylinder 55 mounted with frame 2. The bag sealers 53 are moved horizontally to apply a piece of adhesive tape to the twisted neck portion in the known manner. This effects a sealing of the balloons by retaining a portion of the neck 15 in a twisted configuration.

Figure 11:
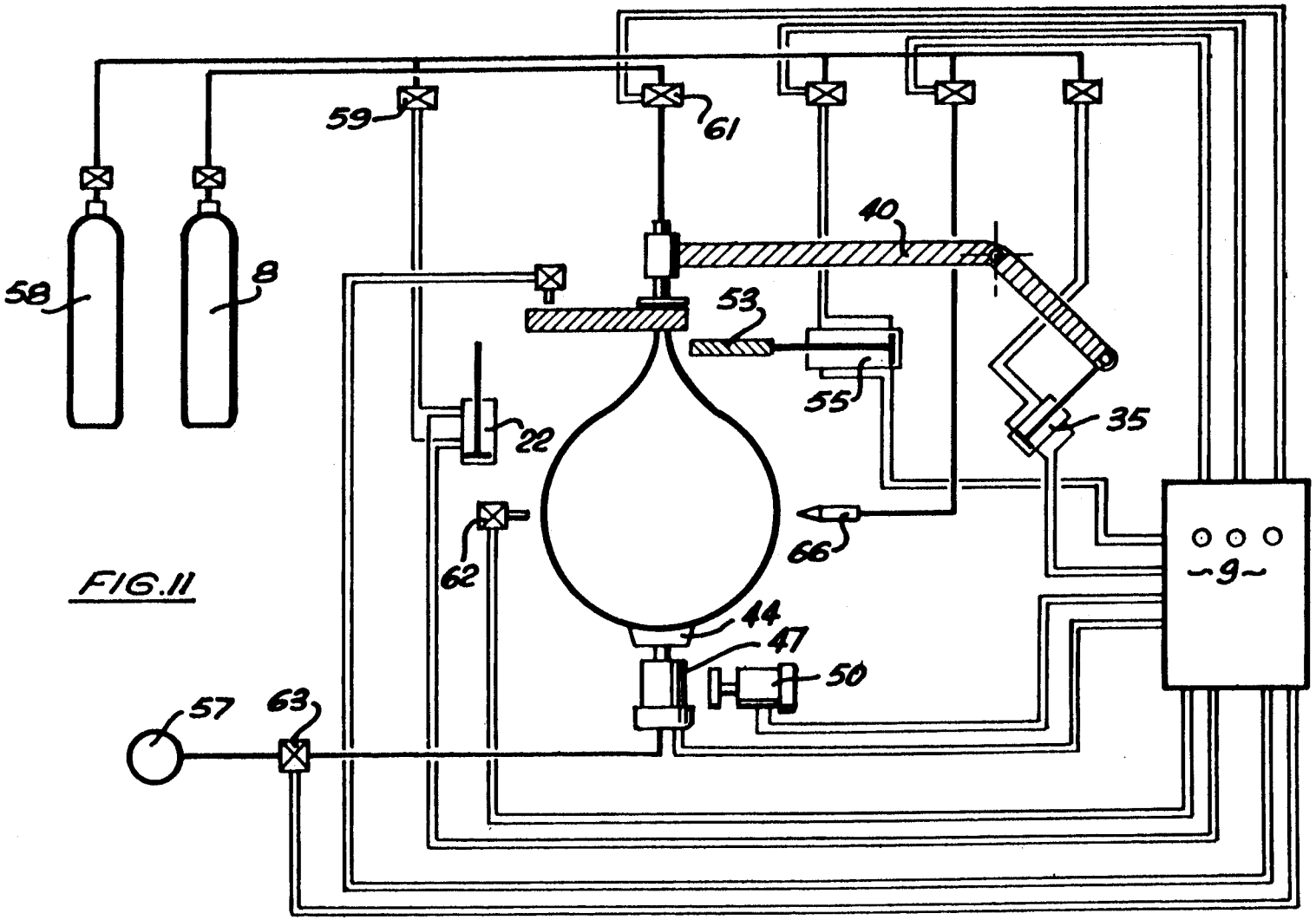
FIG. 11 is a schematic electric and pneumatic circuit diagram of the apparatus shown in FIG. 1.

FIG. 11 shows a schematic electrical and pneumatic circuit diagram of the controls associated with one of the filling stations 5. The remainder of the filling stations operate simultaneously and in the same manner. Control panel 9 contains the necessary circuitry for timing and sequencing of the operation of the device and includes a PLC programmable logic controller unit comprising standard logic controllers.

The operation of the apparatus will now be described with references mainly to FIGS. 1 and 11. Firstly, balloons from balloon trough 4 are manually placed in the adjacent slots 11 of plates 3 forming part of the conveyor loop 1. The conveyor loop is moved in a step like manner by pneumatic cylinder 22 which is supplied with compressed air from cylinder 58 under the control of solenoid valve 59. In this way the conveyor loop is moved such that the plates are moved five slot spacings at each actuation. Filling heads 6 are respectively spaced apart by eleven slot spacings so that a circuit of the conveyor loop is required for each slot to have stopped at a position coinciding with one of the filling heads 6.

After each step like movement of the conveyor loop filling head 6 is bought to bear against plate 3 by the operation of pneumatic cylinder 35 in the manner described above. This results in the beaded edge 16 of the balloon being tightly clamped between sealing surface 10 and the annular clamping flange 41. Whilst so clamped the balloon is inflated with helium from cylinder 8 controlled by solenoid valve 61 which is disposed within filling head 6. An inflation detector 62 in the form of a microswitch is used to close solenoid valve 61 when the balloon is inflated to the desired size. During inflation the balloon 13 expands into suction cap 44. After closing of valve 61 a vacuum pump 57 is connected to suction cap 44 under control of a further solenoid valve 63. The balloon neck is then stretched in the manner described above and the balloon rotated by means of electric motor 47. Bag sealer 53 is applied to the neck of the balloon by the operation of pneumatic cylinder 55. After sealing of the balloon the filling head 6 is lifted to release the beaded edge which slips through slot 11 because the balloon is still retained by suction cap 44. Suction cap 44 is then released and the balloon blown to a discharge area by means of air jet 66. The next step like movement of the conveyor loop is then effected by pneumatic cylinder 22 and the process repeated.

The foregoing describes only one embodiment of the invention and modifications be made thereto without departing from the scope of the invention.

I claim:

1. An apparatus for inflating balloons of the kind having a body and a filling neck terminating in a beaded edge, said apparatus comprising a balloon support plate having a sealing surface and an open ended slot extending from one edge thereof to receive the filling neck of a balloon such that the beaded edge is adjacent said sealing surface and the body of the balloon is disposed on the remote side of the plate; a filling head selectively moveable toward said sealing surface to clamp said beaded edge between the filling head and sealing surface and establish a substantially gas tight seal between the filling head and beaded edge; and a pressurised gas flow passage through said filling head to the neck of a clamped balloon for inflation of the balloon.

2. An apparatus for inflating balloons according to claim 1 wherein the slot width is about two times the bead thickness.

3. An apparatus for inflating balloons according to claim 2 wherein the slot width is between two times the bead thickness and two times the bead thickness plus 1 mm.

4. An apparatus for inflating balloons according to claim 1 wherein attachment means are provided to grip the body of an inflating balloon to pull the body away from the support plate whilst the beaded edge is clamped.

5. An apparatus for inflating balloons according to claim 4 wherein the attachment means is in the form of a suction cup.

6. An apparatus for inflating balloons according to claim 4 wherein the attachment means is operable to stretch the neck of the balloon to between 3 and 6 times its original length.

7. An apparatus for inflating balloons according to claim 4 wherein the attachment means rotates the body of the balloon with respect to the clamped beaded edge so as to result in a tight twisting of the balloon neck.

8. An apparatus for inflating balloons according to claim 7 including a sealing device selectively operable to apply a sealing element to the twisted neck in order to seal the inflated balloon.

9. An apparatus for inflating balloons according to claim 8 wherein the number of twists within a 12 mm length of the twisted balloon neck when using a 12 mm width adhesive strip is at least 1 and no more than 3.

10. An apparatus for inflating balloons according to claim 1 wherein the support plate has a plurality of open ended slots extending from one edge thereof and is mounted with conveyor means to sequentially align each slot with a filling head.

11. An apparatus for inflating balloons according to claim 10 wherein the conveyor means are in the form of an endless loop with a plurality of support plates mounted thereon.

12. An apparatus for inflating balloons according to claim 10 wherein a plurality of filling heads are provided around the closed loop with suitable indexing means to respectively align each slot with one of the filling heads.

13. An apparatus for inflating balloons according to claim 12 wherein 5 filling heads are provided each spaced apart by 11 slot widths and the conveyor is indexed 5 slot widths at a time.

14. An apparatus for inflating balloons according to claim 1 wherein sensor means are provided to detect the degree of inflation of each balloon and terminate filling uniformly.

15. An apparatus for inflating balloons according to claim 14 wherein the sensor means are in the form of a suitably positioned proximity switch providing a control signal used to switch an electrically controlled gas supply valve.

16. An apparatus for inflating balloons according to claim 1 wherein the balloons are manually positioned in the open ended slots of the support plates.

17. An apparatus for inflating balloons according to claim 15 wherein the sequencing of the apparatus is controlled via a logic controller.

18. An apparatus for inflating balloons according to claim 8 wherein the sealing element is an adhesive strip.

* * * * *